US008579723B2

(12) United States Patent
Nakamura

(10) Patent No.: US 8,579,723 B2
(45) Date of Patent: Nov. 12, 2013

(54) GOLF CLUB HEAD AND METHOD FOR MANUFACTURING THE SAME

(75) Inventor: Takashi Nakamura, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 13/441,405

(22) Filed: Apr. 6, 2012

(65) Prior Publication Data

US 2012/0190477 A1 Jul. 26, 2012

Related U.S. Application Data

(62) Division of application No. 12/538,418, filed on Aug. 10, 2009, now Pat. No. 8,172,699.

(30) Foreign Application Priority Data

Nov. 5, 2008 (JP) ..... 2008-284613

(51) Int. Cl.
*A63B 53/04* (2006.01)

(52) U.S. Cl.
USPC ..... 473/331; 473/342

(58) Field of Classification Search
USPC ..... 473/324–350
See application file for complete search history.

(56) References Cited

U.S. PATENT DOCUMENTS

| | | | | |
|---|---|---|---|---|
| 4,852,880 | A * | 8/1989 | Kobayashi | 473/349 |
| 4,917,384 | A * | 4/1990 | Caiati | 473/330 |
| 5,437,088 | A * | 8/1995 | Igarashi | 29/527.6 |
| 5,643,110 | A * | 7/1997 | Igarashi | 473/330 |
| 5,766,087 | A * | 6/1998 | Kawamatsu | 473/290 |
| 5,804,272 | A * | 9/1998 | Schrader | 428/40.1 |
| 5,851,158 | A * | 12/1998 | Winrow et al. | 473/330 |
| 6,679,788 | B1 * | 1/2004 | Heinrich et al. | 473/324 |
| 6,814,673 | B2 * | 11/2004 | Wahl et al. | 473/331 |
| 7,014,568 | B2 * | 3/2006 | Pelz | 473/287 |
| 7,354,354 | B2 * | 4/2008 | Palumbo et al. | 473/320 |
| 7,568,983 | B2 * | 8/2009 | Gilbert | 473/330 |
| 7,594,863 | B2 * | 9/2009 | Ban | 473/331 |
| 7,641,570 | B2 * | 1/2010 | Yokota | 473/331 |
| 7,674,188 | B2 * | 3/2010 | Ban | 473/330 |
| 7,677,990 | B2 * | 3/2010 | Ban | 473/331 |
| 7,695,377 | B2 * | 4/2010 | Yamagishi et al. | 473/331 |
| 7,780,549 | B2 * | 8/2010 | Park et al. | 473/331 |
| 8,012,036 | B2 * | 9/2011 | Nakamura | 473/290 |
| 2003/0126734 | A1 * | 7/2003 | Takeda | 29/557 |
| 2004/0043831 | A1 * | 3/2004 | Lu | 473/342 |
| 2009/0163290 | A1 * | 6/2009 | Beaulieu | 473/331 |

(Continued)

FOREIGN PATENT DOCUMENTS

| | | | |
|---|---|---|---|
| JP | 05-076625 | A | 3/1993 |
| JP | 05076625 | A * | 3/1993 |

(Continued)

*Primary Examiner* — Alvin Hunter
(74) *Attorney, Agent, or Firm* — Birch, Stewart, Kolasch & Birch, LLP

(57) ABSTRACT

A golf club head has a clubface for striking a ball, wherein face grooves are formed by pressing a die; a metallic skin is forming on the clubface including the interior surfaces of the face grooves so that the surface roughness Ral of the interior surfaces of the face grooves becomes not more than 0.20 micrometers; the interior surface of the face grooves is masked with a masking agent; the clubface is provided with a surface roughness of more than 0.20 micrometers by blasting abrasive; and then the masking agent is removed from the face grooves.

13 Claims, 12 Drawing Sheets

(56) References Cited

U.S. PATENT DOCUMENTS

| | | | | |
|---|---|---|---|---|
| 2009/0305812 | A1* | 12/2009 | Nakamura | 473/331 |
| 2010/0113180 | A1* | 5/2010 | Nakamura | 473/331 |
| 2010/0304883 | A1* | 12/2010 | Gilbert et al. | 473/324 |
| 2010/0317459 | A1* | 12/2010 | Ban | 473/331 |

FOREIGN PATENT DOCUMENTS

| | | | | |
|---|---|---|---|---|
| JP | 7-323101 | A | | 12/1995 |
| JP | 07323101 | A | * | 12/1995 |
| JP | 8-52243 | A | | 2/1996 |
| JP | 08052243 | A | * | 2/1996 |
| JP | 8-187308 | A | | 7/1996 |
| JP | 08187308 | A | * | 7/1996 |
| JP | 10-118228 | A | | 5/1998 |
| JP | 10118228 | A | * | 5/1998 |
| JP | 10-216275 | A | | 8/1998 |
| JP | 10216275 | A | * | 8/1998 |
| JP | 10-234894 | A | | 9/1998 |
| JP | 10234894 | A | * | 9/1998 |
| JP | 11-70190 | A | | 3/1999 |
| JP | 11070190 | A | * | 3/1999 |
| JP | 2000-342723 | A | | 12/2000 |
| JP | 2000342723 | A | * | 12/2000 |
| JP | 2001-170228 | A | | 6/2001 |
| JP | 2001170228 | A | * | 6/2001 |
| JP | 2001-321469 | A | | 11/2001 |
| JP | 2002-191731 | A | | 7/2002 |
| JP | 2002191731 | A | * | 7/2002 |
| JP | 2007-82615 | A | | 4/2007 |
| JP | 2007082615 | A | * | 4/2007 |
| JP | 2007-301017 | A | | 11/2007 |
| JP | 2010-11878 | A | | 1/2010 |
| JP | 2010011878 | A | * | 1/2010 |

* cited by examiner

GOLF CLUB HEAD AND METHOD FOR MANUFACTURING THE SAME

The present application is a Divisional of application Ser. No. 12/538,418, filed on Aug. 10, 2009 now U.S. Pat. No. 8,172,699, the entire contents of which are hereby incorporated by reference and for which priority is claimed under 35 U.S.C. §120.

BACKGROUND OF THE INVENTION

The present invention relates to a golf club head and a method for manufacturing the same, more particularly to face grooves which can self-eject foreign substance therein to prevent decrease in the frictional force between the clubface and the ball.

In general, a golf club head is provided in the clubface for striking a ball with face grooves in order to increase a frictional force between the clubface and ball at impact. During golf play, foreign substances, e.g. liquid, mud, grass, the cover material of the ball and the like are very liable to be pushed into the face grooves. If such foreign substances, especially, dirt packed in the face grooves are still remained in the face grooves at the time of striking the ball, the edges of the face grooves can not function well, and the frictional force is decreased. If the frictional force is decreased, it becomes difficult to produce an adequate backspin on the struck ball. As a result, depending on the degree and distribution of the residual foreign substances, the carry distance varies wide. In other words, the carry distance is not stable. This is very problematic for iron-type golf clubs especially short iron clubs with which players frequently try to have a clear shot to the green.

SUMMARY OF THE INVENTION

It is therefore, an object of the present invention to provide a golf club head and a method for manufacturing the same, in which foreign substances pushed into the face grooves are easily self-ejected to ensure a sufficient friction between the clubface and the ball to thereby allow the club head to produce stable backspins and carry distances.

According to one aspect of the present invention, a golf club head comprises:

a clubface for striking a ball comprising a contact face and face grooves, and a metallic skin covering the contact face and interior surfaces of the face grooves, wherein the metallic skin on the interior surfaces of the face grooves has a surface roughness Ral of not more than 0.20 micrometers, and the metallic skin on the contact face is roughened by blasting abrasive to have a surface roughness Raf of more than 0.20 micrometers.

According to another aspect of the present invention, a method for manufacturing the golf club head comprises the steps of:

forming the face grooves in the clubface by pressing a die onto the clubface, wherein the die has a principal surface and ribs protruding from the principal surface, the ribs arranged in a pattern corresponding to the inverted shape of the face grooves be incused;

forming the metallic skin on the clubface including the interior surfaces of the face grooves so that the surface roughness Ral of the metallic skin on the interior surfaces of the face grooves is not more than 0.20 micrometers;

masking the interior surface of the face grooves with a masking agent;

blasting abrasive to at least a central part of the clubface so that said at least central part which excludes the face grooves has a surface roughness of more than 0.20 micrometers; and removing the masking agent from the face grooves.

In this application, the term "surface roughness" means the "arithmetical mean deviation of the assessed profile" defined in section 4.2.1 of Japanese Industrial Standard B0601 "Geometrical Product specifications (GPS)—Surface texture: Profile method—Terms, definitions and surface texture parameters" in 2001.

The "surface roughness" is measured according to Section 7 "Rules and procedures for the measurement of surface roughness using stylus instruments" of Japanese Industrial Standard B0633 "Geometrical Product Specifications (GPS)—Surface texture: Profile method—Rules and procedures for the assessment of surface texture" in 2001.

In this applications, the dimensions refer to the values measured under the standard state of the club head unless otherwise noted.

Here, the standard state of the club head 1 is such that the club head is set on a horizontal plane HP so that the axis CL of the clubshaft (not shown) is inclined at the lie angle (alpha) while keeping the axis CL on a vertical plane VP, and the clubface 2 forms its loft angle (beta) with respect to the vertical plane VP. Incidentally, in the case of the club head alone, the center line of the shaft inserting hole (h) can be used instead of the axis CL of the clubshaft.

The sweet spot SS is the point of intersection between the clubface 2 and a straight line N drawn normally to the clubface 2 passing the center of gravity G of the head.

The front-back direction is a direction parallel with the straight line N projected on the horizontal plane HP.

The toe-heel direction is a direction parallel with the horizontal plane HP and perpendicular to the front-back direction.

The up-down direction is a direction perpendicular to the horizontal plane HP.

BRIEF DESCRIPTION OF THE DRAWINGS

FIG. 8(*b*) is an enlarged cross sectional view showing another example of the auxiliary groove.

FIG. 11(*b*) is an enlarged ceramics cross sectional view of the face grooves and auxiliary grooves thereof from which the masking agent is wiped away.

DESCRIPTION OF THE PREFERRED EMBODIMENTS

Figure 1:
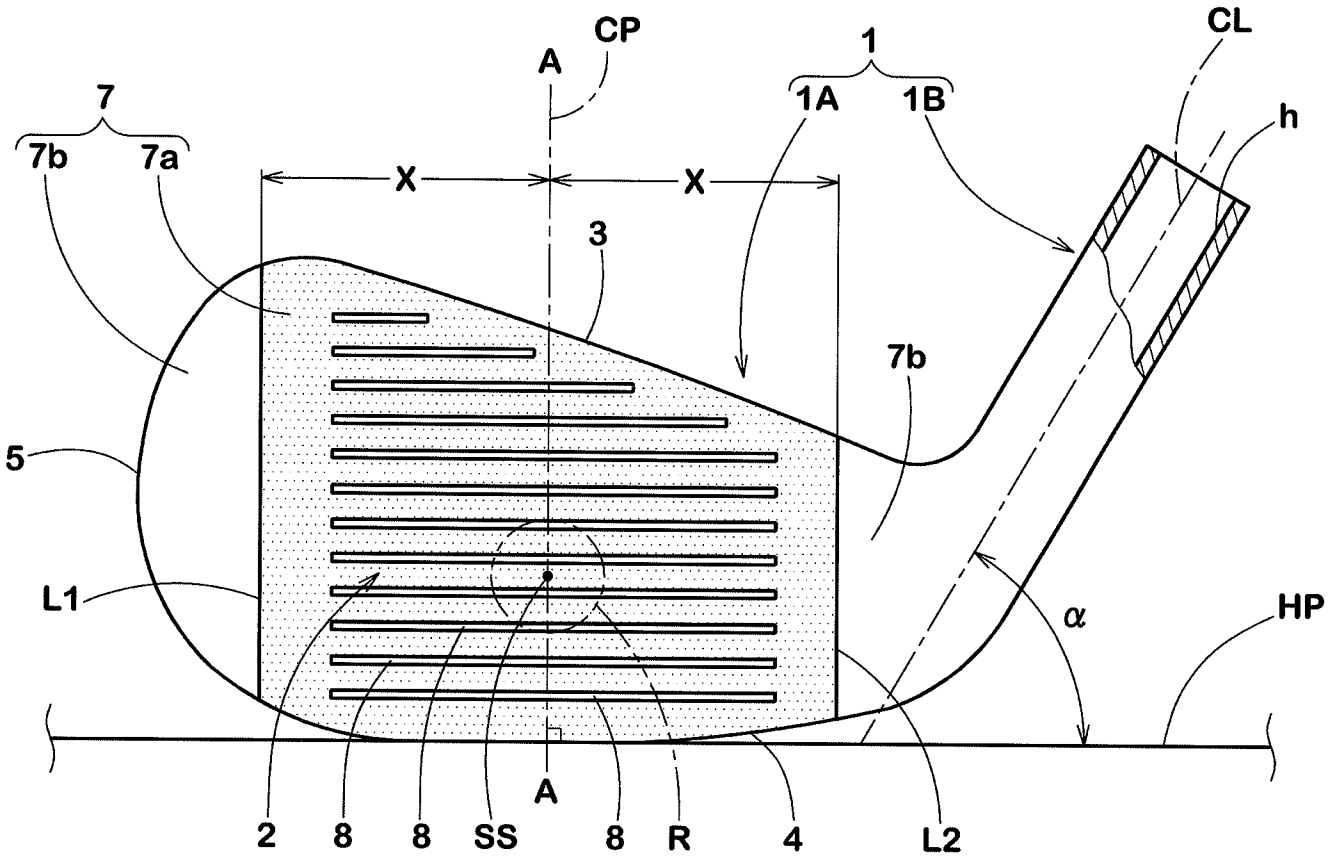
FIG. 1 is a front view of a golf club head according to the present invention.
Figure 2:
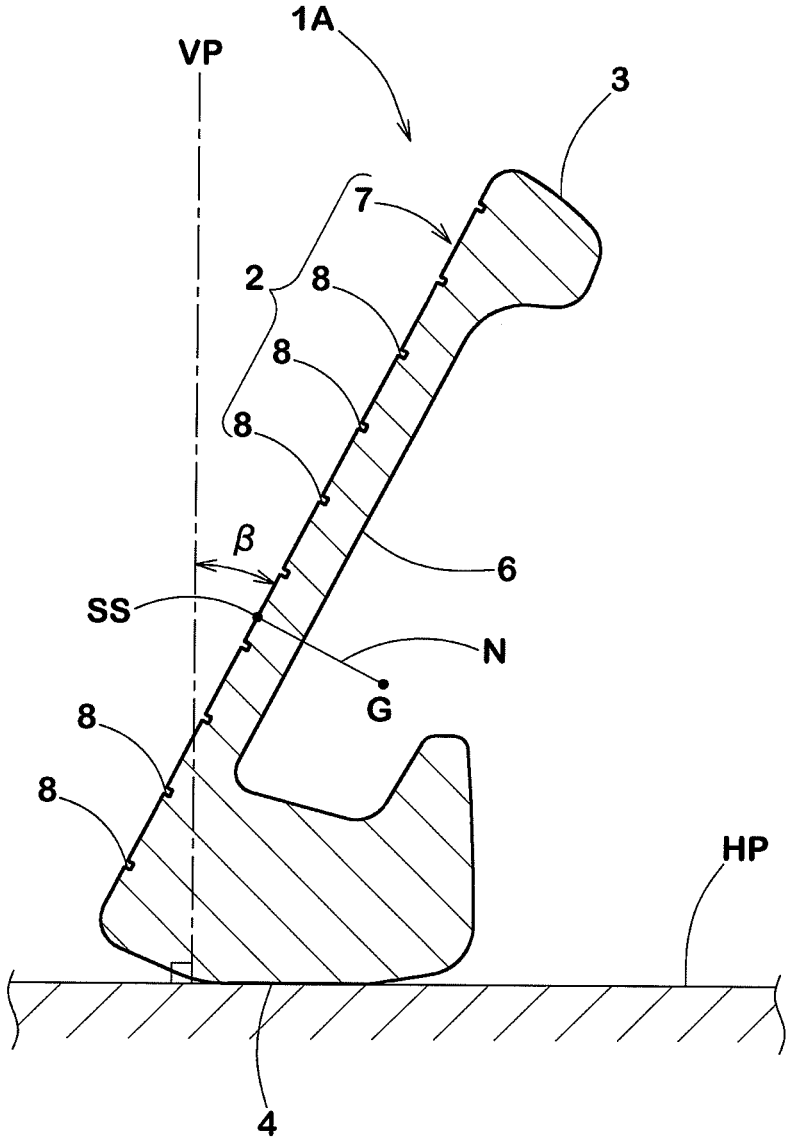
FIG. 2 is a cross sectional view thereof taken along line A-A in FIG. 1.
Figure 3:
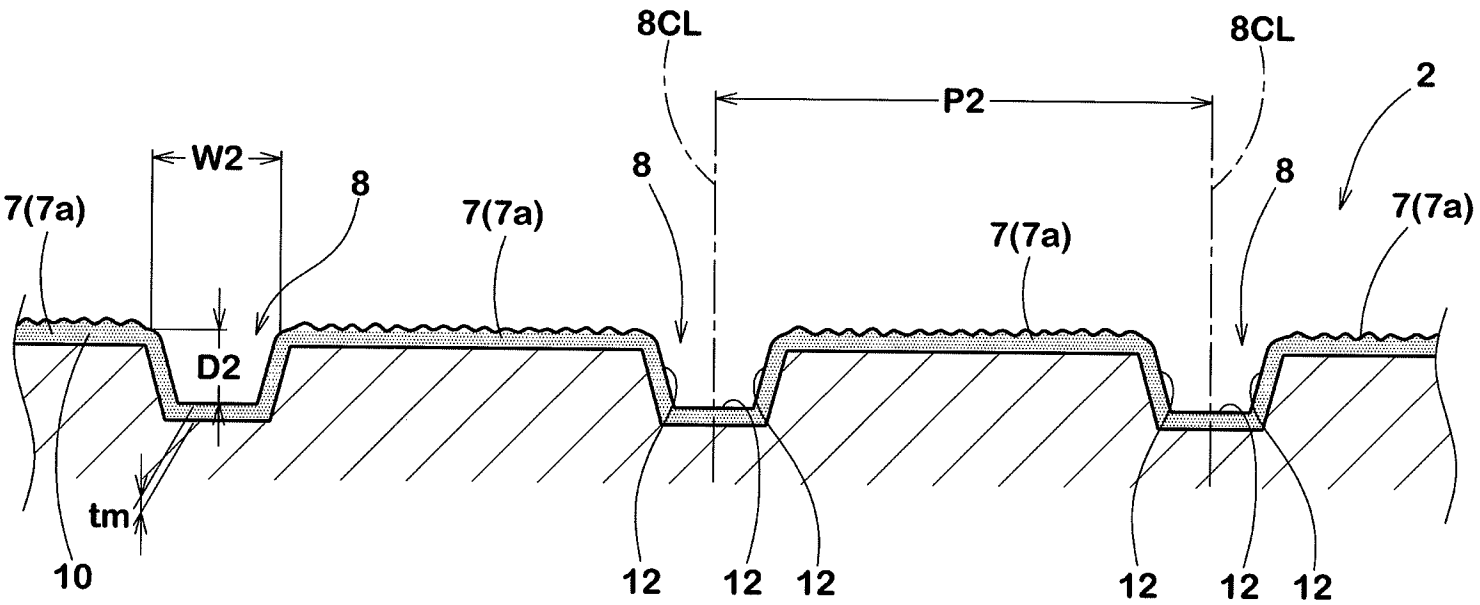
FIG. 3 is an enlarged cross sectional view of the face grooves thereof.

Embodiments of the present invention will now be described in detail in conjunction with accompanying drawings.

The present invention is suitably applied to iron-type golf clubs which have to be able to increase the backspin and decrease the variation of carry distance, namely, short iron clubs, e.g. wedge and the like, more specifically, iron clubs having a loft angle of not less than 30 degrees, preferably not less than 35 degrees, more preferably not less than 40 degrees, but not more than 70 degrees, preferably not more than 65 degrees, more preferably not more than 60 degrees.

In the drawings, golf club head 1 according to the present invention is an iron-type golf club head for such a short iron club. The golf club head 1 comprises:

a main body portion 1A whose front surface defines a clubface 2 for striking a ball; and a hosel portion 1B formed on the heel-side of the main body portion 1A integrally therewith and provided with a shaft inserting hole (h) into which the tip end of a club shaft (not shown) is inserted.

In this embodiment, the entirety of the club head 1 is made of at least one kind of metal material, for example, carbon steel, stainless steel, maraging steel, titanium alloy and the like, through a casting process, forging process or the like.

The main body portion 1A has: the above-mentioned clubface 2; a top face 3 intersecting the clubface 2 at the upper edge thereof and inclining downwards from the toe toward the heel; a sole surface 4 intersecting the clubface 2 at the lower edge thereof and extending substantially parallel with the toe-heel direction; a toe surface extending between the top face 3 and sole surface 4 while curving convexly; and a back surface 6 opposite to the clubface 2.

The clubface 2 comprises a contact face 7, a plurality of face grooves 8, and optionally undermentioned auxiliary grooves 9.

The contact face 7 is the part of the clubface 2 excluding the face grooves 8 and undermentioned optional auxiliary grooves 9, and it is macroscopically a single flat surface intended to contact with the ball.

The face grooves 8 are arranged at intervals in the up-and-down direction so as to extend substantially parallel with the toe-heel direction. The expression "substantially parallel" is meant for the difference in the angle between the toe-heel direction and the longitudinal direction of the face groove 8 which is at most about 4 degrees.

The face grooves 8 are formed so as to meet the specifications specified in Rules of Golf, Appendix II—Design of clubs, 5. club Face, c. Impact Area Markings, (i) Grooves. In this invention, the depth of the face grooves 8 is further limited to values of not less than 0.15 mm.

Accordingly, the face grooves 8 in this invention refer to those having all of the following specifications: (1) width W2: not more than 0.9 mm, using the 30 degree method of measurement on file with the R&A; (2) Depth D2: not less than 0.15 mm and not more than 0.508 mm; (3) Cross-section: a symmetrical cross-section having sides which do not converge; (4) Grooves are straight and parallel; (5) The width, spacing and cross-section of the grooves are constant; (6) Rounding of groove edges is in the form of a radius not more than 0.508 mm; (7) The distance between edges of adjacent grooves is not less than three times the width of the grooves, and not less than 1.905 mm.

The clubface 2 including the contact face 7 and the interior surface of the face grooves 8 is completely covered with a metallic skin 10.

For the metallic skin 10, various metal materials, for example, nickel, chromium, zinc, cobalt, copper, silver and the like can be used. Especially, the use of nickel, chromium and/or cobalt is preferred for their excellent anticorrosive and high-hardness natures. In this embodiment, therefore, a Ni—cr alloy is used for the metallic skin 10.

The thickness tm of the metallic skin 10 is set in a range of not less than 5 micrometers, preferably not less than 10 micrometers, more preferably not less than 15 micrometers, but not more than 40 micrometers, preferably not more than 35 micrometers, more preferably not more than 30 micrometers.

Such metallic skin 10 can improve the resistance to corrosion and erosion of the clubface 2 and help to prevent a degradation of the appearance. If the thickness tm is less than 5 micrometers, such resistance becomes insufficient. If more than 40 micrometers, due to the increased rigidity of the metallic skin, the metallic skin is liable to be exfoliated during use. Further, as the most important function the metallic skin 10, the metallic skin 10 can smoothen the unavoidable microscopical convexoconcave of the clubface 2, especially those of the interior surface of the face grooves 8.

Therefore, the metallic skin 10 on the interior surface of the face grooves 8 has a smooth surface 12 having a surface roughness Ral of not more than 0.20 micrometers.

Accordingly, the coefficient of friction of the surface 12 of the face grooves 8 is reduced, and small objects entered in the face grooves 8 are easily ejected by vibrations of the head, impact of a ball, centrifugal force during swing and the like. Preferably, the surface roughness Ral of the smooth surface 12 is set to be not more than 0.15 micrometers, more preferably not more than 0.13 micrometers.

But, to extremely decrease the surface roughness Ral requires a difficult work or another surface treatment, therefore, the manufacturing cost tends to increase. From this standpoint, it is preferable that the surface roughness Ral of the smooth surface 12 of the face grooves 8 is not less than 0.05 micrometers, more preferably not less than 0.08 micrometers, still more preferably not less than 0.10 micrometers.

Incidentally, the metallic skin 10 on the interior surface of the face groove 8 means the metallic skin 10 formed on the bottom 8*a* and sidewalls 8*b* of the face groove 8.

To the contrary, if the metallic skin 10 on the contact face 7 has a surface roughness Raf of less than 0.20 micrometers, it is difficult to produce a sufficient backspin on the struck ball. Therefore, the metallic skin 10 on the contact face 7 is roughened to have a roughened surface 7*a* whose surface roughness Raf is more than 0.20 micrometers, preferably not less than 0.25 micrometers, more preferably not less than 0.30 micrometers.

However, if the surface roughness Raf of the roughened surface 7*a* is more than 0.55 micrometers, the head becomes liable to abrade the surface of the ball. Therefore, the surface roughness Raf of the roughened surface 7*a* is preferably not more than 0.55 micrometers, more preferably not more than 0.50 micrometers, still more preferably not more than 0.45 micrometers.

Such surface roughness Raf is provided by blasting abrasive such as sand and grit.

The roughened surface 7*a* has to be formed at least in a region surrounded by a circle (R) of 5 mm radius centered on the sweet spot SS. Preferably, this region extends to the upper edge and lower edge of the clubface as in the embodiments shown in the drawings. With respect to the toe-heel direction, it is preferable that the region extends towards the heel and the heel from a vertical plane CP including the sweet spot SS and being perpendicular to the clubface 2, to a position in the toe-heel direction at a distance X of not less than 3 mm, preferably not less than 5 mm, more preferably not less than 8 mm, still more preferably not less than 10 mm.

In this embodiment, further, on each of the toe-side and heel-side of the roughened surface 7*a*, a smoothed surface 7*b* having a surface roughness of not more than 0.2 micrometers is formed to constitute a part of the contact face 7. This smoothed surface 7*b* is a mirror finished surface, and the boundary between the roughened surface 7*a* and the smoothed surface 7*b* is a straight line L1, L2 extending vertically when viewed from the front of the head. The face grooves 8 in this example are formed within the region between the straight lines L1 and L2, but as a modification thereof, the face grooves 8 can extend beyond one of or both of the lines L1 and L2.

As has been explained, the roughened surface 7*a* can be formed only in a central part of the clubface. But, it can be formed all over the clubface.

The ratio (Ral/Raf) of the surface roughness Ral of the smooth surface 12 of the face grooves 8 to the surface roughness Raf of the roughened surface 7*a* of the contact face 7 is preferably not more than 0.80, more preferably not more than 0.70, still more preferably not more than 0.50, but in view of the production efficiency and cost, not less than 0.10, more preferably not less than 0.15, still more preferably not less than 0.20.

If the depth D2 of the face grooves 8 is inadequate, foreign substances such as water and dirt on the ball are unremoved, and it becomes difficult to produce sufficient backspin. Therefore, the depth D2 is preferably not less than 0.20 mm, more preferably not less than 0.25 mm, still more preferably not less than 0.30 mm. However, it is preferable that the depth D2 is not more than 0.50 mm, more preferably not more than 0.45 mm, still more preferably not more than 0.40 mm to ensure the ejection of foreign substances from the face grooves 8.

If the face grooves 8 are narrow in width, foreign substances are unremoved, and it is difficult to produce sufficient backspin. Therefore, the groove width W2 of the face grooves 8 is preferably not less than 0.30 mm, more preferably not less than 0.40 mm, still more preferably not less than 0.50 mm. If the width W2 of the face grooves 8 becomes excessively increased, the area of the contact face 7 is decreased accordingly, and it becomes difficult to produce sufficient backspin. Therefore, the width W2 is preferably not more than 0.90 mm, more preferably not more than 0.80 mm, still more preferably not more than 0.70 mm.

Furthermore, for the similar reasons, the cross-sectional area of the face grooves 8 is preferably not less than 0.08 sq.mm, more preferably not less than 0.09 sq.mm, still more preferably not less than 0.10 sq.mm, but not more than 0.45 sq.mm, more preferably not more than 0.40 sq.mm, still more preferably not more than 0.38 sq.mm.

If the distance P2 between the widthwise center lines 8CL of the adjacent face grooves 8 is too short, the area of the contact face 7 is decreased, and it becomes difficult to produce sufficient backspin. Therefore, the distance P2 is preferably not less than 2.5 mm, more preferably not less than 3.0 mm, still more preferably not less than 3.3 mm.

However, if the distance P2 becomes too long, the backspin tends to become insufficient in case of rain. Therefore, the distance P2 is preferably not more than 4.4 mm, more preferably not more than 4.1 mm, still more preferably not more than 3.8 mm.

Figure 4A:
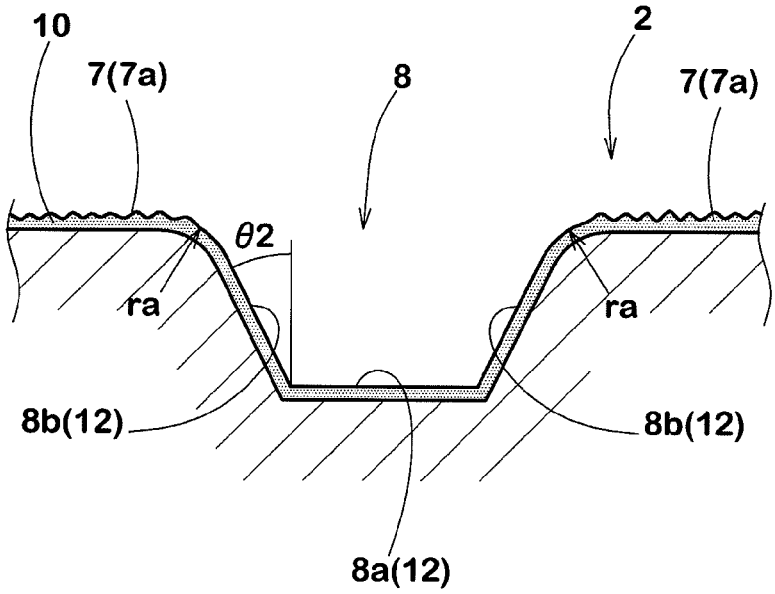
FIGS. 4(*a*) and 4(*b*) are enlarged cross sectional views each showing another example of the face groove.
Figure 4B:
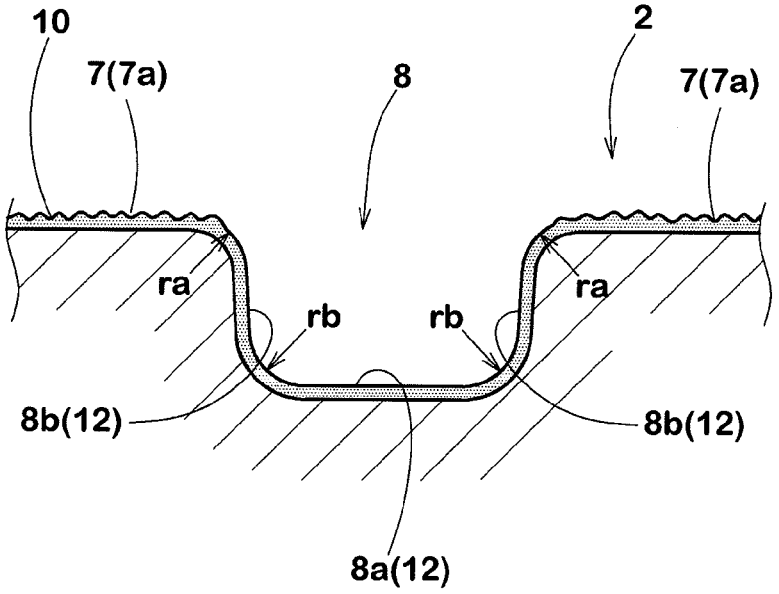

It is preferable that, as shown in FIG. 4, the sidewalls 8*b* of the face groove 8 are inclined at an angle θ2 of not less than 1 degree, preferably not less than 3 degrees, more preferably not less than 5 degrees with respect to the normal direction to the face 7 so that the width increases from the bottom to the top of the groove to promote the ejection of foreign substances. The above-mentioned width W2 is the width at the groove top.

However, if the inclination angle θ2 becomes too large, the backspin decreases. Therefore, the inclination angle θ2 is preferably not more than 30 degrees, more preferably not more than 25 degrees, still more preferably not more than 20 degrees.

As shown in FIGS. 4(*a*) and 4(*b*), the edges of the face groove 8 can be rounded by a radius (ra) of not less than 0.12 mm, preferably not less than 0.13 mm, more preferably not less than 0.14 mm, but not more than 0.40 mm, preferably not more than 0.38 mm, more preferably not more than 0.36 mm.

If the radius (ra) is less than 0.12 mm, the surface of the ball is very liable to be cut. If the radius (ra) is more than 0.40 mm, it becomes different to produce adequate backspin.

As shown in FIG. 4(*a*), the corners between the groove bottom 8*a* and sidewalls 8*b* of the face groove 8 can be angled. But, as shown in FIG. 4(*b*), the corners can be rounded by an arc having a radius (rb) of not less than 0.12 mm, preferably not less than 0.13 mm, more preferably not less than 0.14 mm. If the radius (rb) is excessively increased, the volume of the face grooves 8 decrease, and the foreign substances tend to remain unremoved, Therefore, the radius (rb) is preferably not more than 0.40 mm, more preferably not more than 0.38 mm, still more preferably not more than 0.36 mm.

In the example shown in FIG. 4(*a*), the inclination angle θ2 is 30 degrees, therefore, the cross sectional shape of the face groove 8 is trapezoidal. In the example shown in FIG. 4(*b*), the inclination angle θ2 is 1 degree, therefore, the cross sectional shape of the face groove 8 is almost rectangle, but due to the rounded corners, the cross sectional shape is a wide U-shaped than a rectangle. The cross sectional shape of the face grooves 8 is not limited to such shapes. For example, triangular shape, arched shape and others can be used as far as the cross-section is symmetrical and the sides do not converge.

Figure 5:
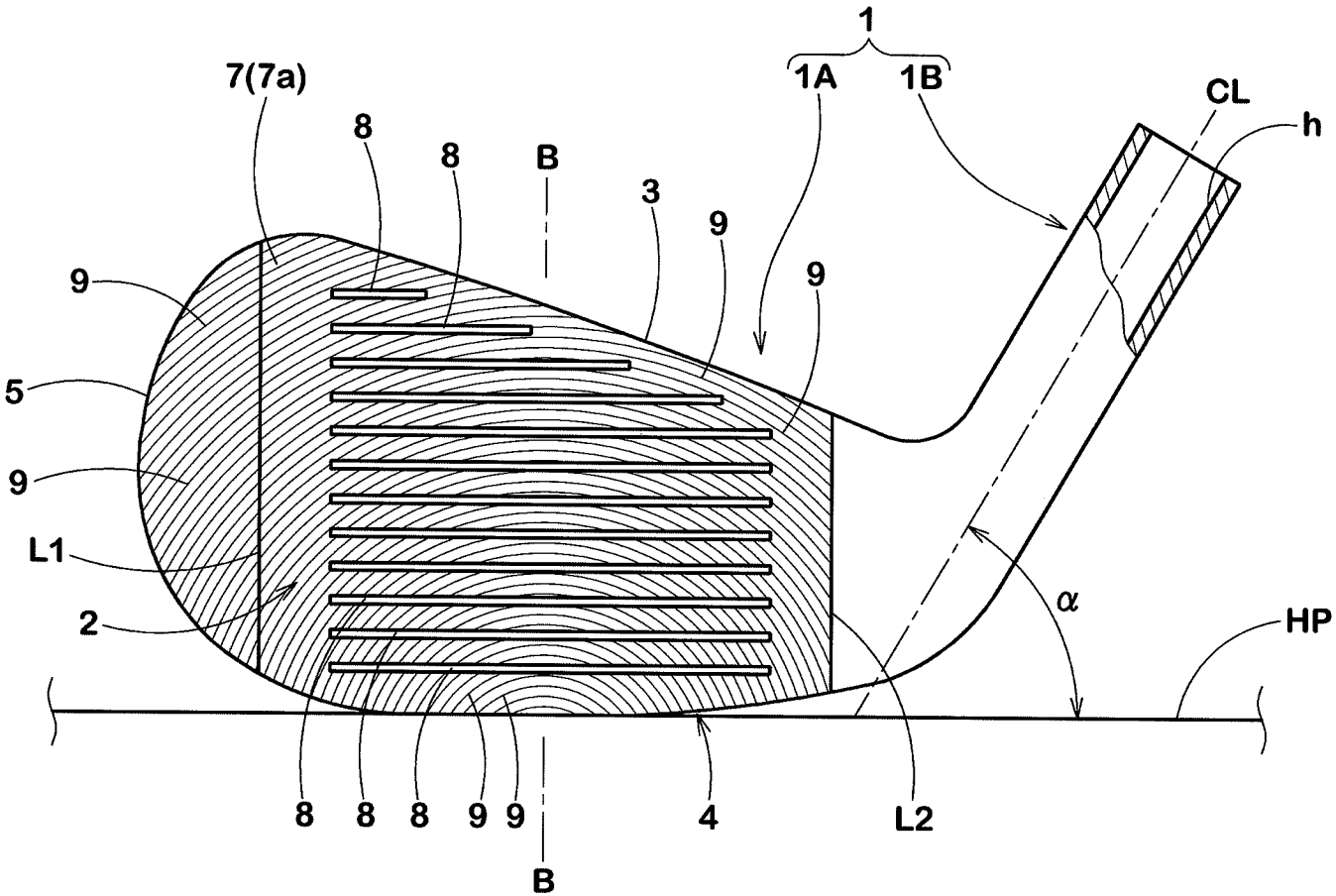
FIG. 5 is a front view of a golf club head according to the present invention.
Figure 6:
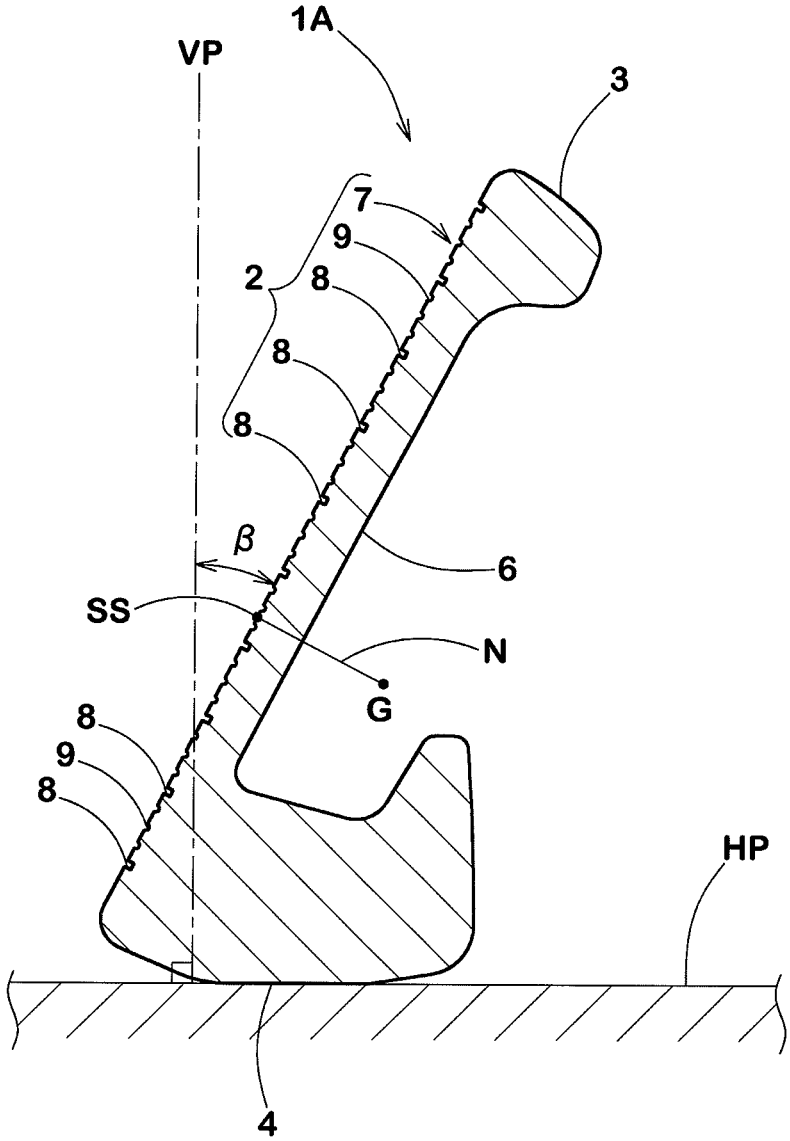
FIG. 6 is a cross sectional view thereof taken along line B-B in FIG. 5.
Figure 7:
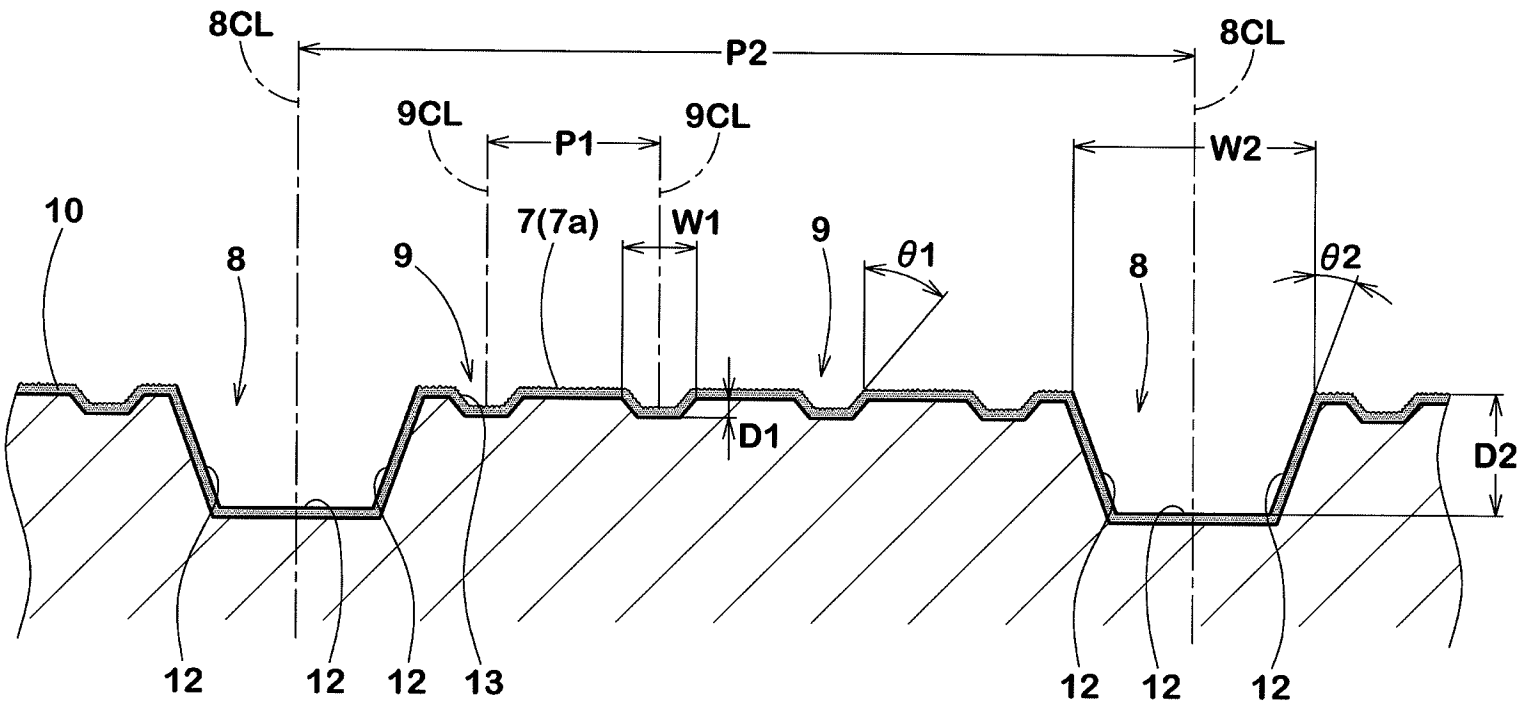
FIG. 7 is an enlarged cross sectional view showing the face grooves and auxiliary grooves thereof.

FIGS. 5, 6 and 7 show another embodiment of the present invention, of which major difference from the former embodiment is that the clubface 2 is further provided with a plurality of auxiliary grooves 9. Therefore, the descriptions of the above embodiment are all applied to this embodiment.

The auxiliary grooves 9 are smaller in width and depth than the face grooves 8. The area provided with the auxiliary grooves 9 extends over the substantially entire area of the clubface 2 excluding the face grooves 8. The auxiliary grooves 9 are substantially parallel each other, and the distance P1 between the widthwise center lines 9CL thereof is substantially constant. The distance P1 is preferably not less than 0.30 mm, more preferably not less than 0.35 mm, still more preferably not less than 0.40 mm, but not more than 0.70 mm, more preferably not more than 0.65 mm, still more preferably not more than 0.60 mm.

In this embodiment, when viewed perpendicularly to the clubface, the auxiliary grooves 9 are arcs of concentric circles of which center is positioned outside the clubface 2 below the sole. But, it is not always necessary that the auxiliary grooves 9 are arcs of concentric circles. Wavy or zigzag configurations or straight configuration can be used as well.

Figure 8A:
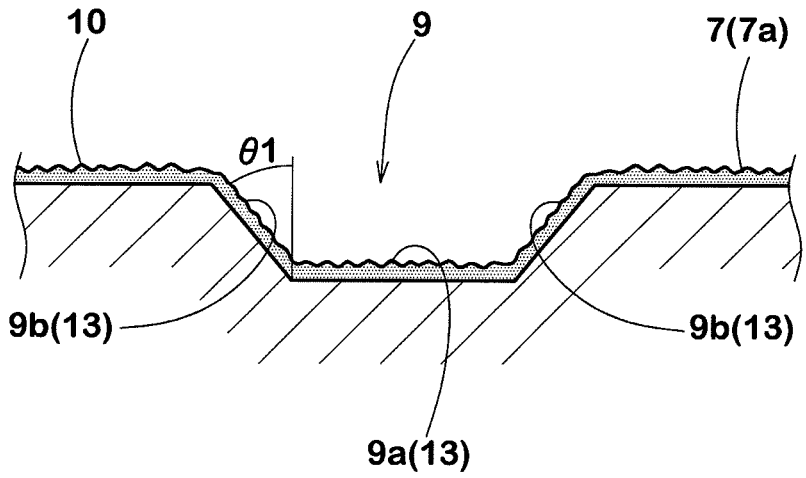
FIG. 8(*a*) is an enlarged cross sectional view showing the auxiliary groove.
Figure 8B:
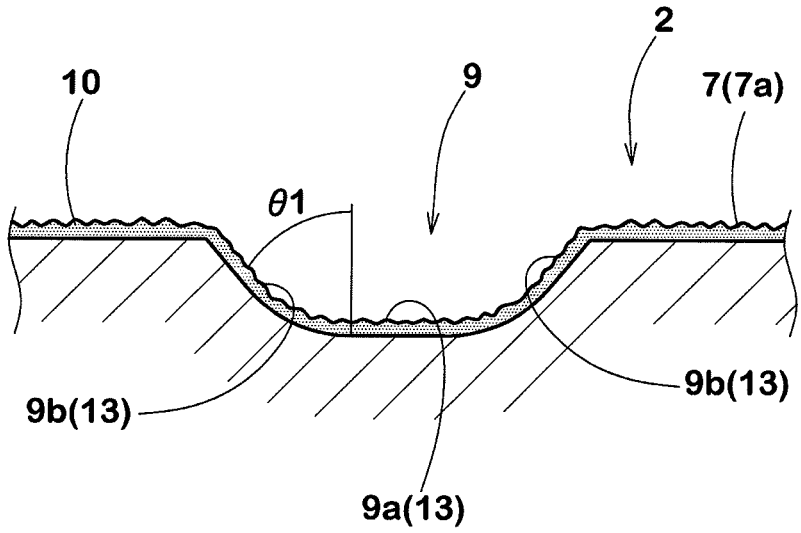

As shown in FIG. 8(*a*), in the cross-section of the auxiliary groove 9 in this embodiment, the groove sidewalls 9*b* are substantially straight and inclined towards the both sides at an angle θ1, and the bottom 9*a* is parallel with the contact face 7. Therefore, the cross-sectional shape of the auxiliary groove 9 is substantially trapezoidal.

In this embodiment, the corners between the sidewalls 9*b* and groove bottom 9*a* are angled. But, the corners between the sidewalls 9*b* and groove bottom 9*a* can be rounded by an arc as shown in FIG. 8(*b*).

The above-mentioned metallic skin 10 also covers the interior surface of the auxiliary grooves 9.

The above-mentioned abrasive blast treatment is carried out on the contact face including the auxiliary grooves 9. Therefore, at least the edges of the auxiliary grooves 9 are roughened more or less. Namely, in the case that the abrasive size is larger than the width W1 of the auxiliary grooves 9, the abrasive can not reach to the interior of the auxiliary groove 9, therefore, only the groove edges are roughened.

In the case that the abrasive size is smaller than the width W1 of the auxiliary grooves 9, the surface of the metallic skin 10 on the interior surface of the auxiliary groove 9 is roughened, and the roughened surface 13 having a surface roughness Ras of not more than 0.20 micrometers is formed.

In cooperation with the roughened surface 7*a* of the contact face 7, the auxiliary grooves 9 can produce steady backspin. Further, the stress occurring on the surface (cover) of the ball at impact can be widely dispersed from the face grooves 8 to the auxiliary grooves 9, therefore, it is possible to increase the friction between the ball and clubface and prevent the ball from being damaged.

As shown in FIG. 7, the auxiliary groove 9 has a depth D1 of from 0.005 to 0.025 mm, a width W1 of from 0.10 to 0.50 mm, and an inclination angle θ1 of from 40 to 70 degrees. These values serve the purpose when manufacturing the golf club head as described hereinafter.

Taking the golf club head 1 shown in FIGS. 5 to 7 as an example, the method for manufacturing a golf club head according to the present invention will now be described in detail.

In the first step, the club head 1 not provided with the face grooves 8, auxiliary 9, and metallic skin 10 is produced in an appropriate manner, for example, forging, casting and the like as is conventionally done.

Figure 9A:
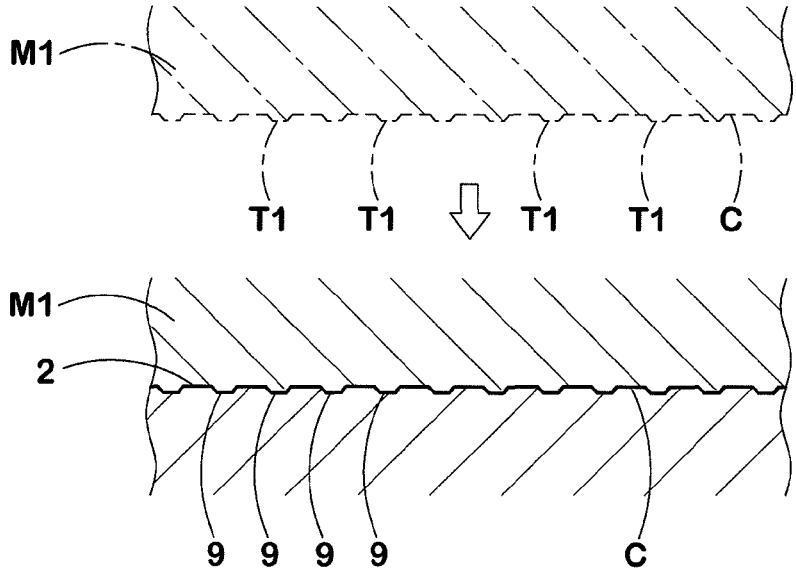
FIGS. 9(*a*)-9(*c*) are cross sectional views for explaining a method for manufacturing the golf club head shown in FIG. 5.
Figure 9B:
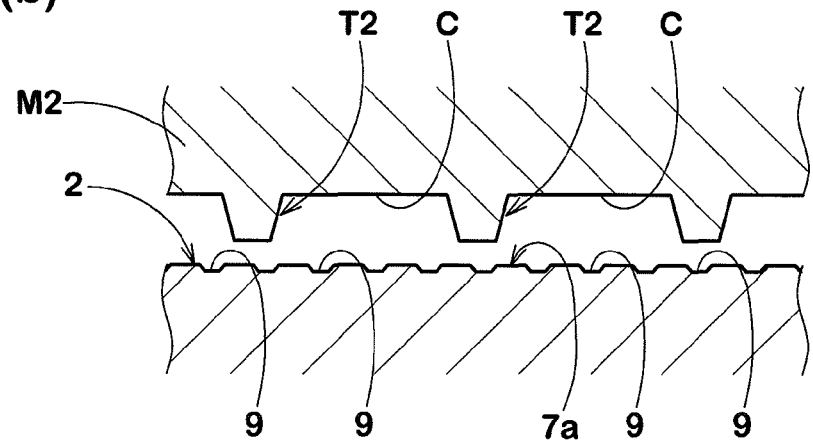
Figure 9C:
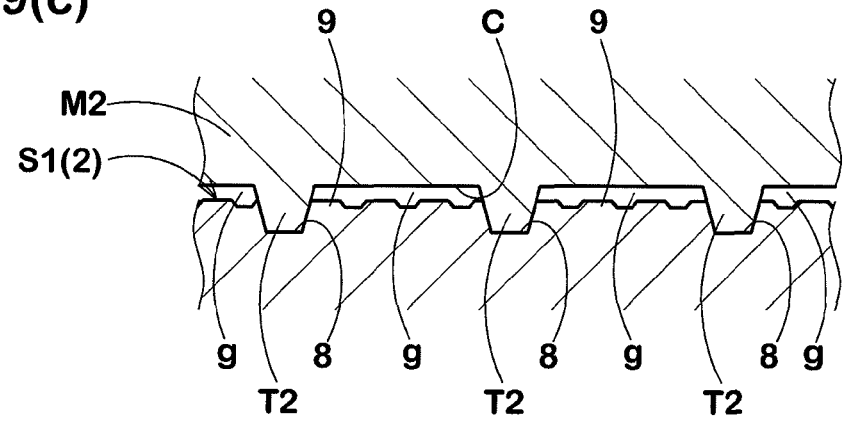

In the second step, if desired, preparations of the clubface 2 are made for example utilizing a milling machine or the like, and then the auxiliary grooves 9 are formed on the clubface 2. In this embodiment, as shown in FIG. 9(*a*), in order to form the auxiliary grooves 9, a first die M1 is pressed onto the clubface 2. The first die m1 has a shaping face comprising a single flat principal surface C and small ribs T1 protruding from the principal surface C and arranged in a pattern corresponding to the inverted shape of the auxiliary grooves 9 to be incused. The sizes of the small ribs T1 are almost same as those of the auxiliary grooves 9. Through this press process, the auxiliary grooves 9 are first formed in the clubface 2 without the metallic skin 10.

In the third step, the face grooves 8 are formed. As shown in FIGS. 9(*b*) and 9(*c*), a second die M2 is pressed on the clubface 2. The second die M2 has a shaping face comprising a single flat principal surface C and large ribs T2 protruding from the principal surface C and arranged in a pattern corresponding to the inverted shape of the face grooves 8 to be incused. Through this second press process, the face grooves 8 are formed in the clubface 2, superimposing on the auxiliary grooves 9.

In this second press process, it is preferable to control the movement of the second die M2 such that even when the second die M2 is pressed maximally, the principal surface C does not contact with the clubface 2 and a certain space (g) is remained therebetween as shown FIG. 9(*c*). In other words, the clubface 2 is pressed by only the large ribs T2 not to deform the auxiliary grooves 9 previously formed in the contact face 7.

Therefore, the part of the large rib T2 which penetrates into the clubface 2 has almost same sizes as the face groove 8, but the protruding amount of the large rib T2 from the principal surface C is larger than the depth of the face groove 8.

If the auxiliary grooves 9 are formed after the formation of the face grooves 8, then the edges of the face grooves 8 become irregular due to the small ribs T1 crossing the edges, and the appearance of the face grooves 8 is seriously deteriorated. In contrast, when the auxiliary grooves 9 and the face grooves 8 are formed in this order, the edges of the face grooves 8 can be formed sharply without deteriorating the appearance.

The large ribs T2 of the second die M2 are preferably provided with a surface roughness Rat of not more than 0.2 micrometers, more preferably not more than 0.15 micrometers, but not less than 0.03 micrometers, more preferably not less than 0.05 micrometers. Therefore, by using the second die M2 having such large ribs T2, the formation of the face grooves 8 and the provision of the surface roughness Ral can be made at the same time. Of course it is also possible to provide the above surface roughness Ral by polishing the interior surface of the face groove 8.

Figure 10:
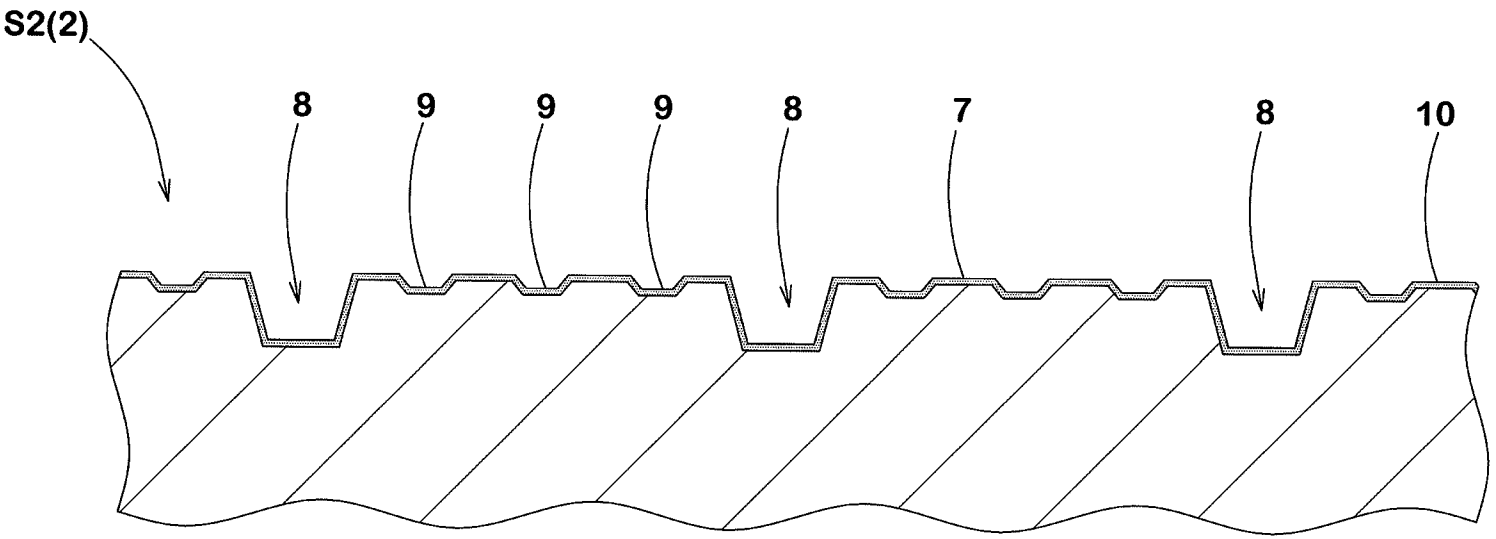
FIG. 10 is an enlarged cross sectional view of the clubface which is covered by the metallic skin.

In the fourth step, in order that at least the interior surface of the face grooves 8 has the surface roughness Ral of not more than 0.20 micrometers, the metallic skin 10 is formed on the clubface 2 provided with the face grooves 8 and auxiliary grooves 9 as shown in FIG. 10.

As far as the metallic skin 10 can provide a surface roughness Ral of not more than 0.20 micrometers, various methods, for example, electroplating, nonelectrolytic plating, hot-dip plating, composite coating, anodic coating, and the like can be utilized to form the metallic skin 10.

In the fifth step, only the face grooves 8 are masked with a masking agent 14.

Figure 11A:
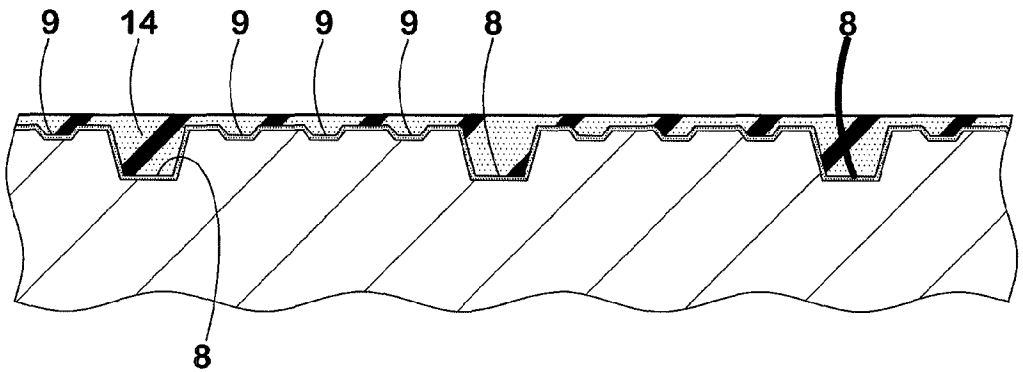
FIG. 11(*a*) is an enlarged cross sectional view of the face grooves and auxiliary grooves thereof on which a masking agent is applied.
Figure 11B:
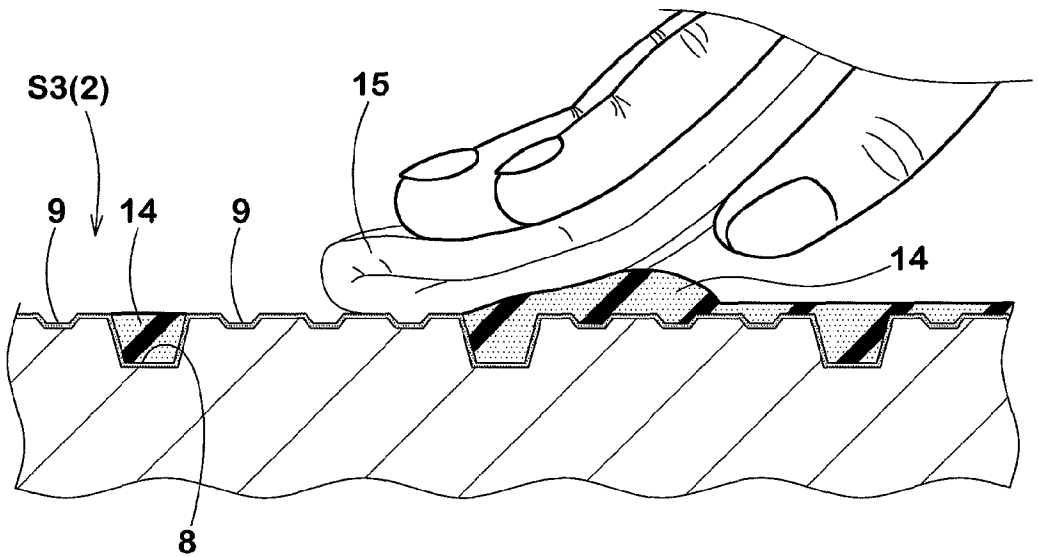

The masking of the face grooves 8 can be made for example: as shown in FIG. 11(*a*), the masking agent 14 is first applied to an area covering all of the face grooves 8, for example, the entire area of the clubface; and then as shown in FIG. 11(*b*), well before the masking agent 14 is hardened, the masking agent 14 is wiped away so that the masking agent 14 remains only in the face grooves 8.

Therefore, it is preferable that, at the time of applying the masking agent 14, the masking agent 14 is fluid and the viscosity thereof is not less than 3 Pascal second, preferably not less than 5 Pascal second, more preferably not less than 10 Pascal second, but not more than 70 Pascal second, preferably not more than 60 Pascal second, more preferably not more than 50 Pascal second. The masking agent 14 then hardens. The viscosity was measured at 25 degrees c with B-type rotational viscometer.

For such masking agent 14, various types of masking agents, for example, acrylic-type, silicone-type, ester-type, synthetic rubber-type and the like can be used. Especially preferably used are reactive masking agents such as silicone-type and acrylic-type which react to moisture in the air and start to harden.

The present inventor found through experiments that, by limiting the width W1, depth D1 and sidewall inclination angle θ1 of the auxiliary grooves 9 to the values in the above-mentioned ranges, the uncured masking agent 14 in the auxiliary grooves 9 can be removed therefrom relatively easily by a simple operation to wipe away with a soft waste cloth 15 and the like as shown in FIG. 11(*b*). Accordingly, the above measurements of the auxiliary grooves 9 are very important factors in view of not only the improvement in the friction of the clubface 2 but also the efficiency of the masking agent removing work.

If the groove depth D1 of the auxiliary grooves 9 is less than 0.005 mm, or the groove width W1 is less than 0.10 mm, or the inclination angle θ1 of the sidewalls is more than 70 degrees, then it becomes difficult to increase the frictional force between the clubface 2 and ball.

If the depth D1 of the auxiliary grooves 9 is more than 0.025 mm, or the groove width W1 is more than 0.50 mm, or the inclination angle θ1 of the sidewall is less than 40 degrees, then in the wiping away operation, it becomes difficult to fully remove the masking agent 14 from the auxiliary grooves 9. Therefore, the depth D1 of the auxiliary grooves 9 is preferably not less than 0.010 mm, more preferably not less than 0.015 mm, but not more than 0.023 mm, more preferably not more than 0.020 mm.

The width W1 of the auxiliary grooves 9 is preferably not less than 0.15 mm, more preferably not less than 0.20 mm, but not more than 0.45 mm, more preferably not more than 0.40 mm.

The inclination angle θ1 is preferably not less than 45 degrees, more preferably not less than 50 degrees, but not more than 60 degrees, more preferably not more than 55 degrees.

It is desirable that the inclination angle θ1 of the auxiliary grooves 9 is more than the inclination angle θ2 of the sidewalls of the face grooves 8. Especially, the difference (θ1-θ2) therebetween is preferably not less than 20 degrees, more preferably not less than 30 degrees. Thereby, by moving the waste cloth 15 at a right angle to the auxiliary grooves 9, the masking agent 14 can be removed from the auxiliary grooves 9 while allowing the masking agent 14 to stay in the face grooves 8. However, if the difference (θ1−θ2) is too large, the effect to improve the friction due to the auxiliary grooves 9 decreases, or the ball tends to get scratched or cut by the edges of the face grooves 8. Therefore, the difference (θ1−θ2) is preferably not more than 60 degrees, more preferably not more than 50 degrees, still more preferably not more than 40 degrees.

Figure 12:
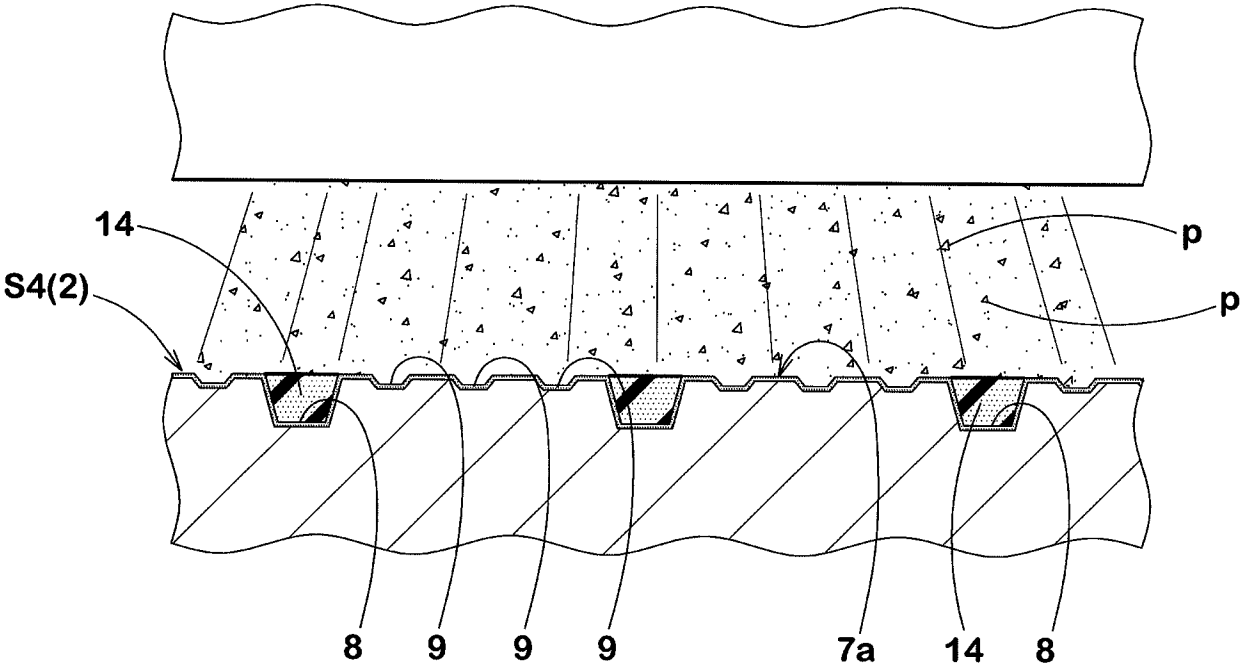
FIG. 12 is a cross sectional view of the clubface to which the abrasive is blasted.

In the sixth step, as shown in FIG. 12, by blasting abrasive (p) to the clubface 2, the portion not masked (specifically, the auxiliary grooves 9 and the contact face 7 excluding the smoothed surface 7*b*) is roughened so that the surface roughness becomes more than 0.20 micrometers.

The surface roughness can be controlled by changing the particle sizes of abrasive p, blasting time and blasting speed.

In the seventh step, the masking agent in the face grooves 8 and on the smoothed surface 7*b* is removed with a spatula made of a material softer than the metallic skin 10 such as resin and wood material.

Thereby, the metallic skin 10 on the contact face 7 and the interior surface of the auxiliary grooves 9 is roughened by the abrasive to have the surface roughness Raf, Ras of more than 0.20 micrometers, but the metallic skin 10 on the interior surface of the face grooves 8 is not roughened and keeps the surface roughness Ral of not more than 0.20 micrometers.

It is further understood by those skilled in the art that the foregoing description is a preferred embodiment of the invention and that various changes and modifications may be made in the invention without departing from the scope of the accompanying claims. For example, the face grooves 8 can be formed by cutting work utilizing a numerical control machine tool or the like. The golf club head can be a wood-type golf club head.

Comparison Tests

Iron-type golf club heads for pitching wedge having a loft angle of 46 degrees and specifications shown in Table 1 were made and tested.

The club heads (Ex.1-Ex.9) according to the present invention were made by forging a soft iron (S25C), forming the auxiliary grooves by pressing a die M1, forming the face grooves by pressing a die M2, forming the metallic skin of Ni—Cr, masking the face grooves, sand blasting, and removing the mask.

For the masking agent, a kind of an adhesive agent commercially available from ThreeBond Co. Ltd. as acrylic liquid gasket 1141 having a viscosity of 15 Pascal second was used.

In the sand blasting process, alumina abrasive having an average particle size of 180 micrometers was blasted for 20 seconds at the air pressure of 0.3 MPa.

The comparative club head (Ref.) was made similarly to the above, but the masking of the face grooves and the removing of the mask were omitted, therefore, the interior surfaces of the face grooves were also roughened by sand blasting.

The face grooves had the following specifications common to all of the heads.

Cross sectional shape: trapezoidal
Depth D2: 0.35 mm
Width W2: 0.70 mm
Distance P2: 3.60 mm
Inclination angle θ2: 15 degrees
Radius of curvature (ra) of groove edges: 0.14 mm The ribs of the die M2 for forming of the face grooves had a surface roughness of 0.05 micrometers.

The auxiliary grooves had a trapezoidal cross sectional shape.

Backspin Test:

The club heads were attached to identical steel shafts to form pitching wedges.

Ten golfers whose handicap ranged from 0 to 9 each hit three-piece golf balls put on turf of about 15 mm length successively thirty times with each of the golf clubs, and the backspin of the struck balls was measured by the use of a ball flight measuring instrument "Trackman" manufactured by ISG A/S Denmark.

The thirty shots by each golfer with each golf club were made on the dried turf in the fairway and also on the wetted turf in the fairway, and with respect to the first ten shots, middle ten shots and last ten shots of the thirty shots, three averages of backspin were obtained. Therefore, it is better that the difference of the averages backspin of the last ten shots from the averages backspin of the first ten shots, namely, the decrease in the backspin is smaller.

Condition of Face Grooves

After the thirty shots were made on the dried turf and also after the thirty shots were made on the wetted turf, the total length of the part of the face grooves in which dirt was remained unejected was measured.

The results are indicated in Table 1, wherein

A: total length was less than 30 mm,
B: total length was not less than 30 mm and less than 100 mm,
C: total length was not less than 100 mm.

Finished State of Clubface

Ten samples of each of the club heads Ex.1-Ex.9 were made, and the contact face and auxiliary grooves were visually observed for splotch caused by the sand blast due to the residual masking agent. Therefore, the influence of the cross sectional shape of the auxiliary grooves on the wiping away of the masking agent may be known from the results.

In Table 1, the number of heads in ten samples in which splotch was observed is shown, therefore, the smaller the number, the better the wiping away of the masking agent.

From the test results, it was confirmed that, according to the present invention, foreign substances remained in the face grooves can be lessened, and the decrease in the backspin is also lessened.

TABLE 1

| Head | Ref. | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|---|
| Clubface (Fig. No.) | 5&7 | 5&7 | 5&7 | 5&7 | 5&7 | 5&7 | 5&7 | 5&7 | 5&7 | 5&7 |
| Auxiliary grooves | | | | | | | | | | |
| depth D1 (mm) | 0.015 | 0.015 | 0.02 | 0.015 | 0.03 | 0.015 | 0.015 | 0.015 | 0.015 | 0.015 |
| width W1 (mm) | 0.3 | 0.3 | 0.3 | 0.5 | 0.3 | 0.3 | 0.3 | 0.3 | 0.3 | 0.3 |
| sidewall angle θ1 (deg) | 50 | 50 | 50 | 50 | 50 | 30 | 40 | 60 | 70 | 80 |
| distance P1 (mm) | 0.5 | 0.5 | 0.5 | 0.5 | 0.5 | 0.5 | 0.5 | 0.5 | 0.5 | 0.5 |
| Sand blasting to face grooves | yes | non | non | non | non | non | non | non | non | non |
| Surface roughness Ral of Face grooves (MIC) | 0.4 | 0.1 | 0.1 | 0.1 | 0.1 | 0.1 | 0.1 | 0.1 | 0.1 | 0.1 |
| Surface roughness Raf of Contact face (MIC) | 0.40 | 0.40 | 0.42 | 0.42 | 0.44 | 0.42 | 0.41 | 0.39 | 0.38 | 0.36 |
| Backspin | | | | | | | | | | |
| Dry first ten (rpm) | 6800 | 6800 | 6820 | 6830 | 6830 | 6820 | 6800 | 6760 | 6730 | 6700 |
| Dry mid ten (rpm) | 6730 | 6760 | 6800 | 6800 | 6790 | 6790 | 6760 | 6740 | 6670 | 6660 |
| Dry last ten (rpm) | 6700 | 6740 | 6770 | 6760 | 6760 | 6760 | 6740 | 6700 | 6660 | 6630 |
| Dry decrease (rpm) | 100 | 60 | 50 | 70 | 70 | 60 | 60 | 60 | 70 | 70 |
| Wet first ten (rpm) | 6600 | 6600 | 6610 | 6610 | 6620 | 6630 | 6600 | 6530 | 6500 | 6400 |
| Wet mid ten (rpm) | 6490 | 6580 | 6580 | 6580 | 6570 | 6590 | 6580 | 6500 | 6460 | 6360 |
| Wet last ten (rpm) | 6330 | 6520 | 6530 | 6520 | 6530 | 6550 | 6520 | 6450 | 6410 | 6310 |
| Wet decrease (rpm) | 270 | 80 | 80 | 90 | 90 | 80 | 80 | 80 | 90 | 90 |
| Condition of face grooves | | | | | | | | | | |
| Dry | B | A | A | A | A | A | A | A | A | A |
| Wet | C | A | A | A | A | A | A | A | A | A |
| Finished state of Clubface | — | 0 | 1 | 1 | 8 | 6 | 2 | 0 | 0 | 0 |

The invention claimed is:

1. A golf club head comprising:

a clubface for striking a ball, the clubface comprising a contact face and face grooves, and a metallic skin covering the contact face and interior surfaces of the face grooves, wherein the metallic skin on the interior surfaces of the face grooves has a surface roughness Ral of not more than 0.20 micrometers, and the metallic skin on the contact face is roughened by blasting abrasive to have a surface roughness Raf of more than 0.20 micrometers and not more than 0.55 micrometers, wherein the cross-sectional area of each of the face grooves is not less than 0.08 sq.mm and not more than 0.45 sq.mm and the sidewalls of each of the face grooves are inclined at an angle θ2 of not less than 3 degrees and not more than 30 degrees, and wherein the clubface further comprises auxiliary grooves, said metallic skin covering the interior surfaces of the auxiliary grooves, the auxiliary grooves have a depth of from 0.005 to 0.025 mm and a width of from 0.10 to 0.50 mm, the auxiliary grooves each have sidewalls inclined at an angle θ1 of from 40 to 70 degrees with respect to the normal direction to the clubface to become wider toward its opening at the clubface, the auxiliary grooves are substantially parallel each other, and the distance P1 between the widthwise center lines of the auxiliary grooves is not less than 0.30 mm and not more than 0.70 mm.

2. The golf club head according to claim 1, wherein the surface roughness Ral of the face grooves is 0.05 to 0.20 micrometers.

3. The golf club head according to claim 1, wherein the thickness of the metallic skin is not less than 5 micrometers and not more than 40 micrometers.

4. The golf club head according to claim 1, which is an iron-type golf club head having a loft angle of not less than 30 degrees and not more than 70 degrees.

5. The golf club head according to claim 1, wherein the ratio (Ral/Raf) of the surface roughness Ral to the surface roughness Raf is not more than 0.80 and not less than 0.10.

6. The golf club head according to claim 1, wherein the depth D2 of the face grooves is not less than 0.20 mm and not more than 0.50 mm.

7. The golf club head according to claim 1, wherein the width W2 of the face grooves is not less than 0.30 mm and not more than 0.90 mm.

8. The golf club head according to claim 1, wherein the distance P2 between the widthwise center lines of the face grooves is not less than 2.5 mm and not more than 4.4 mm.

9. The golf club head according to claim 1, wherein the edges of the face grooves are rounded by a radius (ra) of not less than 0.12 mm and not more than 0.40 mm.

10. The golf club head according to claim 1, wherein the corners between the bottom and sidewalls of each of the face grooves are rounded by an arc having a radius (rb) of not less than 0.12 mm and not more than 0.40 mm.

11. The golf club head according to claim 1, wherein the difference (θ1−θ2) of the inclination angle θ1 of the sidewalls of the auxiliary grooves from the inclination angle θ2 of the sidewalls of the face grooves is not less than 20 degrees and not more than 60 degrees.

12. A golf club head comprising:

a clubface for striking a ball, the clubface comprising a contact face and face grooves, and a metallic skin covering the contact face and interior surfaces of the face grooves, wherein the metallic skin on the interior surfaces of the face grooves has a surface roughness Ral of not more than 0.20 micrometers, and the metallic skin on the contact face is roughened by blasting abrasive to have a surface roughness Raf of more than 0.20 micrometers, wherein the clubface further comprises auxiliary grooves, said metallic skin also covers the interior surfaces of the auxiliary grooves, the auxiliary grooves have a depth of from 0.005 to 0.025 mm and a width of from 0.10 to 0.50 mm, and the auxiliary grooves each have sidewalls inclined at an angle θ1 of from 40 to 70 degrees with respect to the normal direction to the clubface to become wider toward its opening at the clubface, and wherein the auxiliary grooves are substantially parallel each other, and the distance P1 between the widthwise center lines of the auxiliary grooves is not less than 0.30 mm and not more than 0.70 mm.

13. A golf club head comprising:

a clubface for striking a ball, the clubface comprising a contact face and face grooves, and a metallic skin covering the contact face and interior surfaces of the face grooves, wherein the metallic skin on the interior surfaces of the face grooves has a surface roughness Ral of not more than 0.20 micrometers, and the metallic skin on the contact face is roughened by blasting abrasive to have a surface roughness Raf of more than 0.20 micrometers, wherein the clubface further comprises auxiliary grooves, said metallic skin also covers the interior surfaces of the auxiliary grooves, the auxiliary grooves have a depth of from 0.005 to 0.025 mm and a width of from 0.10 to 0.50 mm, and the auxiliary grooves each have sidewalls inclined at an angle θ1 of from 40 to 70 degrees with respect to the normal direction to the clubface to become wider toward its opening at the clubface, and wherein the difference (θ1−θ2) of the inclination angle θ1 of the sidewalls of the auxiliary grooves from the inclination angle θ2 of the sidewalls of the face grooves is not less than 20 degrees and not more than 60 degrees.

* * * * *